US008094076B2

(12) United States Patent
Zhang et al.

(10) Patent No.: US 8,094,076 B2
(45) Date of Patent: Jan. 10, 2012

(54) MULTIBAND ANTENNA

(75) Inventors: Chong Zhang, Shenzhen (CN); Cho-Ju Chung, Taipei Hsien (TW)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 345 days.

(21) Appl. No.: 12/582,783

(22) Filed: Oct. 21, 2009

(65) Prior Publication Data

US 2011/0032166 A1 Feb. 10, 2011

(30) Foreign Application Priority Data

Aug. 6, 2009 (CN) ..... 2009 2 0307494 U

(51) Int. Cl.
*H01Q 1/38* (2006.01)

(52) U.S. Cl. ..... 343/700 MS; 343/824; 343/826; 343/846; 343/829; 343/752

(58) Field of Classification Search ..... None
See application file for complete search history.

(56) References Cited

U.S. PATENT DOCUMENTS

| | | | | |
|---|---|---|---|---|
| 6,552,686 | B2 * | 4/2003 | Ollikainen et al. | 343/700 MS |
| 7,050,010 | B2 * | 5/2006 | Wang et al. | 343/702 |
| 7,180,463 | B2 | 2/2007 | Chung | |
| 7,576,698 | B2 * | 8/2009 | Cheng | 343/700 MS |
| 7,755,545 | B2 * | 7/2010 | Takei et al. | 343/702 |
| 7,825,863 | B2 * | 11/2010 | Martiskainen et al. | 343/702 |
| 7,973,726 | B2 * | 7/2011 | Tseng et al. | 343/702 |
| 7,986,274 | B2 * | 7/2011 | Yang et al. | 343/700 MS |

* cited by examiner

*Primary Examiner* — Trinh Dinh
(74) *Attorney, Agent, or Firm* — Altis Law Group, Inc.

(57) ABSTRACT

A multiband antenna includes a feed portion, a radiating portion, and a ground via. The feed portion includes a first feed section and a second feed section paralleled to each other. The radiating portion includes a first radiator, a second radiator and a third radiator. The first radiator is L shaped with a free end. The second radiator is L shaped with a free end. The free ends of the second radiator and the first radiator extend toward to each other and partially overlap to define a slot therebetween. The third radiator includes a trapezoid section and a connecting section. The short portion includes a first short section and a second short section. The first short section connects the first radiator to the ground via, and the second short section connects the second radiator and the third radiator to the ground via.

11 Claims, 3 Drawing Sheets

MULTIBAND ANTENNA

RELATED APPLICATIONS

This application is based upon and claims the benefit of priority under 35 U.S.C. 119 from an application CHINA 200920307494.2 filed on Aug. 6, 2009, the contents of which are incorporated herein by reference.

BACKGROUND

1. Technical Field

Embodiments of the present disclosure relate to antennas, and especially to a multiband antenna.

2. Description of Related Art

Wireless location area network (WLAN) protocol includes both BLUETOOTH and IEEE 802.11a/b/g standards. BLUETOOTH operates in frequency bands of approximately 2.4 GHz, IEEE 802.11a operates in frequency bands of approximately 5.18 GHz to 5.825 GHz, IEEE 802.11b (also named WiFi) and IEEE 802.11g operates in frequency bands of approximately 2.4 GHz. An antenna is required capable of covering the frequency bands described, complying with the needs of BLUETOOTH and IEEE 802.11a/b/g standard, with development of WLAN technology.

However, frequency bands narrow as dimensions of the antennas decrease. Therefore, development of an antenna with reduced dimensions retaining compatibility with BLUETOOTH and IEEE 802.11a/b/g standard is a priority.

DETAILED DESCRIPTION

Figure 1:
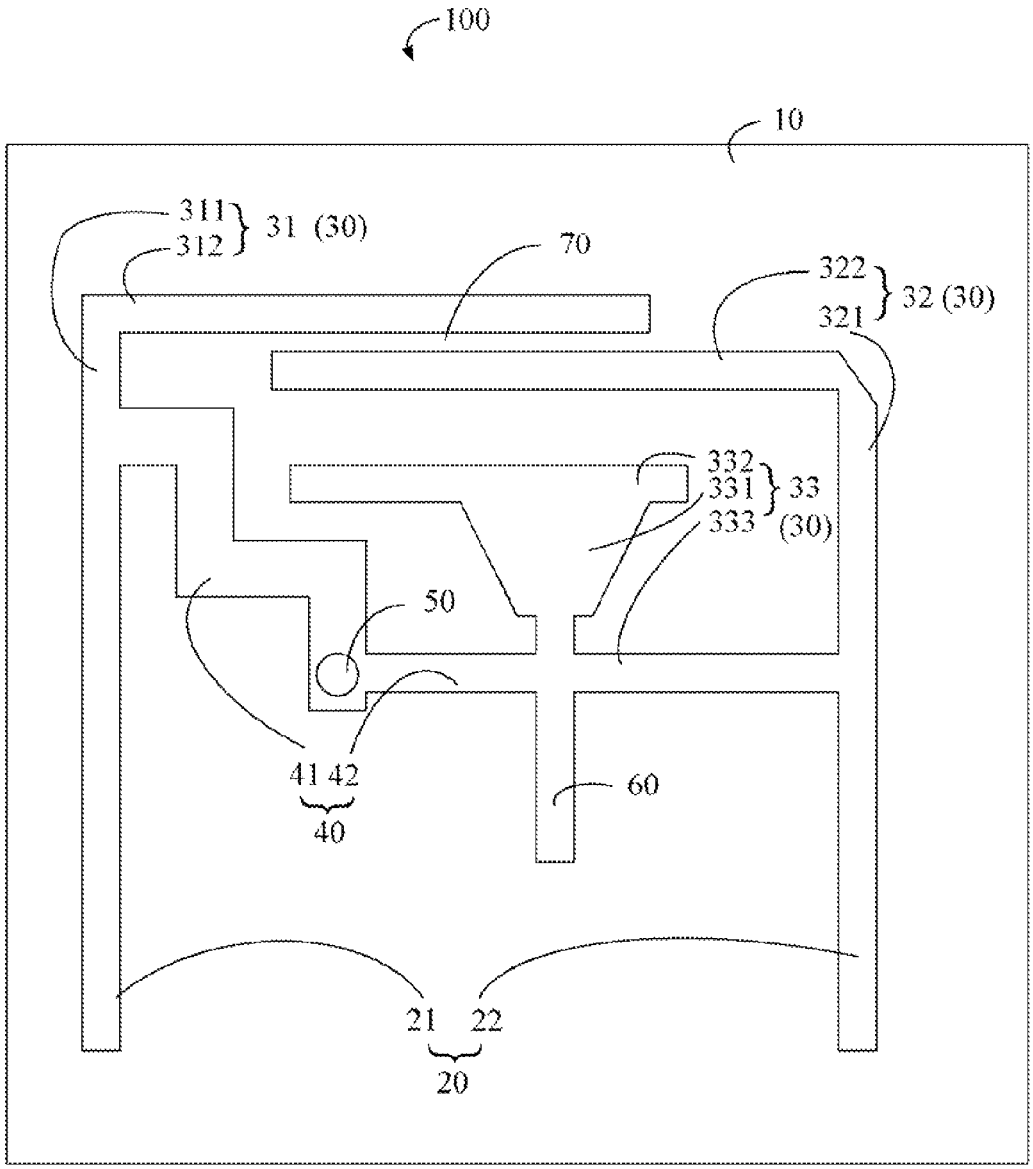
FIG. 1 is a schematic diagram of an embodiment of a multiband antenna according to the present disclosure.

Referring to FIG. 1, a schematic diagram of an embodiment of a multiband antenna 100 as disclosed is shown. The multiband antenna 100 comprises a substrate 10, a feed portion 20, a radiating portion 30 and a short portion 40, a ground via 50 and a matching portion 60. In one embodiment, the feed portion 20, the radiating portion 30 and the short portion 40 are configured on a top side of the substrate 10, a ground portion on a bottom side of the substrate 10, and the radiating portion 30 connected to a ground portion through the ground via 50.

The feed portion 20 is configured for feeding electromagnetic signals, and comprises a first feed section 21 and a second feed section 22. The first feed section 21 and the second feed section 22 are elongated and parallel to each other. The first feed section 21 is configured for feeding first frequency signals, such as 2.4 GHz usable in BLUETOOTH and IEEE 802.11b/g standards, and the second feed section 22 is configured for feeding the first frequency signals and second frequency signals, second frequency signals such as 5 GHz usable in IEEE 802.11a standard.

The radiating portion 30 is electrically connected to the feed portion 20, to transceive electromagnetic signals. The radiating portion 30 comprises a first radiator 31, a second radiator 32 and a third radiator 33.

The first radiator 31 is L shaped, and connected to the first feed section 21, to transceive the first frequency signal. The first radiator 31 comprises a first perpendicular section 311 and a first horizontal section 312. In one embodiment, one end of the first perpendicular section 311 is connected inline with the first feed section 21. The first horizontal section 312 has a free end.

The second radiator 32 is L shaped, and connected to the second feed section 22, to transceive the second frequency signal. The second radiator 32 comprises a second perpendicular section 321 and a second horizontal section 322. In one embodiment, one end of the second perpendicular section 321 is connected inline with the second feed section 22. The second horizontal section 322 has a free end.

In one embodiment, the first perpendicular section 311 is parallel to the first perpendicular section 321. The first horizontal section 312 and the second horizontal section 322 extend toward to each other so that the second horizontal section 322 and the first horizontal section 312 partially overlap, and define a slot 70 therebetween.

The third radiator 33 is connected to the second feed section 22, to transceive the second frequency signal. The third radiator 33 comprises a connecting section 333, a trapezoid section 331 and a third horizontal section 332. In one embodiment, the connecting section 333 connects the second feed section 22 to a top side of the trapezoid section 331. The third horizontal section 332 is elongated and connects to a bottom side of the trapezoid section 331. The third horizontal section 332 neighbors the second horizontal section 322. The third horizontal section 332 and the second horizontal section 322 define the slot 70 therebetween.

The short portion 40 connects the radiating portion 30 to the ground via 50. The short portion 40 comprises a first short section 41 and a second short section 42. The short section 41, bent at an angle, connects the first radiator 31 to the ground via 50. The second short section 42 connects the second radiator 32 and the third radiator 33 to the ground via 50. In one embodiment, the first short section 41 in the angle, is flexible in design, and the slots 70 defined by the radiating portion 30 can increase the coupling effectiveness and improve the return loss of the multiband antenna 100.

In one embodiment, the first feed section 21, the first radiator 31, and the first short section 41 form a planar F antenna. The second feed section 22, the second radiator 32, the connecting section 333, and the second short section 42 form a planar inverted F antenna (PIFA).

The matching portion 60 is elongated, and connected to the first connecting section 333 of the third radiator 33, for impedance matching. In one embodiment, the matching portion 60 is perpendicular to the second short section 42.

Figure 2:
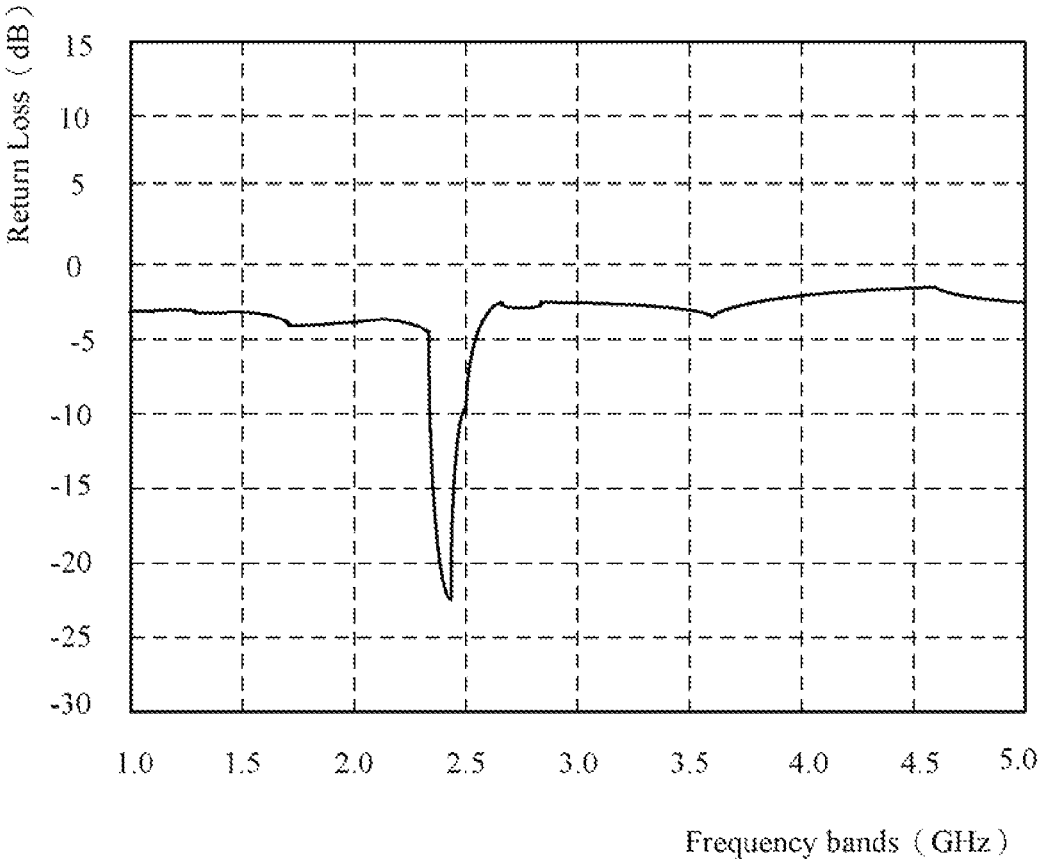
FIG. 2 is a graph showing return loss of a first radiator of the multiband antenna of FIG. 1.
Figure 3:
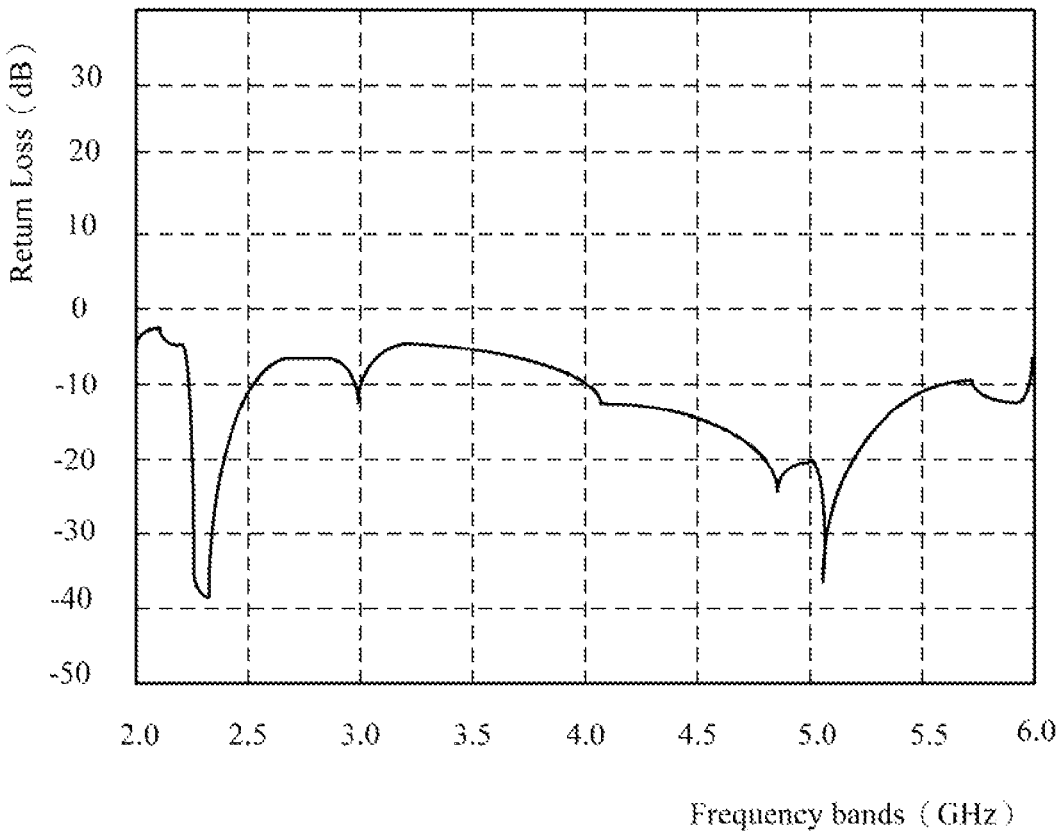
FIG. 3 is a graph showing return loss of a second radiator and a third radiator of the multiband antenna of FIG. 1.

Referring to FIG. 2 and FIG. 3, return loss of the multiband antenna 100 is shown. As shown in FIG. 2, when the first radiator 31 operates at approximately 2.4 GHz, the return loss is less than −10 dB, in accordance with the industry standard. As shown in FIG. 3, when the second radiator 32 operates at approximately 2.4 GHz, the return loss is less than −10 dB, and when the third radiator 33 operates at approximately 5 GHz, the return loss is less than −10 dB, in accordance with the industry standard. Additionally, the frequency bands described cover the BLUETOOTH and IEEE 802.11a/b/g standards.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A multiband antenna, comprising:

a feed portion operable to feed electromagnetic signals and comprising a first feed section and a second feed section parallel to the first feed section;

a radiating portion connected to the feed portion, to transceive electromagnetic signals, comprising:

a first radiator being L shaped, comprising one end connected to the first feed section, and the other end being a free end;

a second radiator being L shaped, comprising one end connected to the second feed section, and the other end being a free end, wherein the free ends of the second radiator and the first radiator extend toward to each other so that the second radiator and the first radiator partially overlap, and define a slot therebetween; and a third radiator comprising a trapezoid section and a connecting section, wherein the connecting section connects the trapezoid section to the second feed section; and a short portion connecting the radiating portion to a ground via, the short portion comprising:

a first short section connecting the first radiator to the ground via, and a second short section connecting the second radiator and the third radiator to the ground via.

2. The multiband antenna as claimed in claim 1, wherein the first feed section, the first radiator, and the first short section form a planar F antenna.

3. The multiband antenna as claimed in claim 2, wherein the second feed section, the second radiator, the connecting section, and the second short section form a planar inverted F antenna.

4. The multiband antenna as claimed in claim 1, further comprising a matching portion, connected to the third radiator and configured for impedance matching.

5. The multiband antenna as claimed in claim 1, wherein first feed section and the second feed section are rectangular.

6. The multiband antenna as claimed in claim 5, wherein the first radiator comprises a first perpendicular section and a first horizontal section, and wherein the first perpendicular section is inline with the first feed section, and the first horizontal section has the free end.

7. The multiband antenna as claimed in claim 6, wherein the second radiator comprises a second perpendicular section and a second horizontal section, and wherein the second perpendicular section is in line of the second feed section, and the second horizontal section has the free end.

8. The multiband antenna as claimed in claim 7, wherein the first horizontal section neighbors the second horizontal section, and defines the slot therebetween.

9. The multiband antenna as claimed in claim 8, wherein the third radiator further comprises a third horizontal section connected to the trapezoid section.

10. The multiband antenna as claimed in claim 9, wherein the third radiator neighbors the second horizontal section, and define the slot therebetween.

11. The multiband antenna as claimed in claim 1, wherein the first short section is bent at an angle.

* * * * *